US005555968A

United States Patent [19]

Seefeldt et al.

[11] Patent Number: 5,555,968

[45] Date of Patent: Sep. 17, 1996

[54] CONVEYING SYSTEM FOR SHEET LAYERS

[75] Inventors: Joachim Seefeldt, Neuffen; Horst Reichle, Lenningen-Gutenberg, both of Germany

[73] Assignee: bielomatik Leuze GmbH + Co., Germany

[21] Appl. No.: 288,564

[22] Filed: Aug. 10, 1994

[30] Foreign Application Priority Data

Aug. 12, 1993 [DE] Germany ..... 43 27 049.2

[51] Int. Cl.[6] ..... B65G 21/14

[52] U.S. Cl. ..... 198/594

[58] Field of Search ..... 198/369.7, 369.1, 198/812, 594

[56] References Cited

U.S. PATENT DOCUMENTS

| | | | |
|---|---|---|---|
| 1,565,944 | 12/1925 | Knoll | 198/594 |
| 1,570,484 | 1/1926 | Hanson | 198/594 |
| 1,609,161 | 11/1926 | Deligianes et al. . | |
| 2,233,151 | 2/1941 | Welk . | |
| 2,477,830 | 8/1945 | Sandberg . | |
| 2,576,217 | 11/1951 | Eggleston | 198/139 |
| 2,768,732 | 10/1956 | Muhlenbruch | 198/139 |
| 3,374,902 | 3/1968 | Mills . | |
| 3,434,584 | 3/1969 | Winkler | 198/594 |
| 3,464,537 | 9/1969 | Thull | 198/369.7 |
| 4,141,443 | 2/1979 | Halsey | 198/471 |
| 4,890,720 | 1/1990 | Brais | 198/592 |
| 4,986,412 | 1/1991 | Brais | 198/592 |
| 5,046,603 | 9/1991 | Odenthal . | |
| 5,280,902 | 1/1994 | Helmstädler | 271/198 |
| 5,307,917 | 5/1994 | Hall | 198/313 |
| 5,351,809 | 10/1994 | Gilmore et al. | 198/812 |

FOREIGN PATENT DOCUMENTS

| | | | |
|---|---|---|---|
| 943095 | 3/1974 | Canada | 198/594 |
| 1361065 | 12/1987 | European Pat. Off. | 198/594 |
| 1652241 | 5/1991 | European Pat. Off. | 198/594 |
| 1558053 | 2/1969 | France . | |
| 1915647 | 10/1970 | Germany . | |
| 2940634A1 | 4/1981 | Germany . | |
| 3446735 | 6/1986 | Germany . | |
| 4213201A1 | 10/1993 | Germany . | |
| 4213201 | 10/1993 | Germany . | |

*Primary Examiner*—William E. Terrell
*Assistant Examiner*—T. Kelly

[57] ABSTRACT

For discharging paper stacks from a conveying path via an outlet a truck is provided with which is opened the outlet immediately adjacent to a packing station and can be closed in a substantially gap-free manner. For this purpose the truck has a closing plate for closing the outlet, which simultaneously serves as a support member for substantially dimensionally rigidly supporting the paper stack in the vicinity of the extended truck. Thus, the associated conveyor can have a relatively small number of conveyor belts.

32 Claims, 3 Drawing Sheets

CONVEYING SYSTEM FOR SHEET LAYERS

BACKGROUND OF THE INVENTION

The invention relates to a conveying means for objects, such as are in particular formed by superimposed layers, e.g. paper stacks and the like.

Such stacks, etc. are to be continuously movable over a long conveying section or the latter is to be so interrupted or shortened that the particular stack does not move over the entire conveying section and is instead discharged therefrom beforehand. For this purpose appropriately a conveyor comprising two or more conveying portions is provided and said two portions are movable transversely against one another or parallel to the conveying plane or conveying direction. Both conveying portions can also have a conveying action in the retracted position or form a through, but shortened conveyor and has a common conveying direction instead of conveying directions transverse to one another. In the case of paper stacks, namely so-called reams of several hundreds to thousand sheet layers such stacks are to be discharged which have been subject to damage, constitute waste for some other reason or due to a malfunction in the conveying direction are not to be conveyed further following the discharge point.

This can e.g. be achieved in that a truck with conveying runners, such as belts, driving the stacks only by friction gripping engagement, forms the movable conveying portion, which has at its extendable or front end a reversing means for the conveying runner or runners. If the said portion is extended, then the conveying runners pass over most of the extended section without support on the back thereof, so that they are flexibly or elastically resiliently curved towards said back under the contact pressure of the particular stack. In the case of conveyor belts an attempt can admittedly be made to counteract this in that said belts are kept taut with tension force in their longitudinal direction or are closely juxtaposed in large numbers and with a small intermediate spacing with respect to their width, but this leads-to increased costs and increased fault proneness and difficult operation of the conveyor.

OBJECTS OF THE INVENTION

An object of the invention is to provide a conveying means in which the disadvantages of the above-described type or known constructions are avoided and which in particular in the case of a simple construction ensures a very reliable supporting of the stacks or the like transversely to the conveying plane and in the vicinity of the portion, if the latter is extended.

SUMMARY OF THE INVENTION

According to the invention means are provided in order to substantially rigidly support the particular stack in the vicinity of the extended portion against elastically resilient movements transversely to and against the conveying plane. This support can be located in a zone behind the front end of the portion and which corresponds to at least ¼ to ⅓ of the total length of the extended portion or is larger than this. With the portion extended, the support can also be connected with a small spacing or directly to the front end of the residual portion or can extend with interruptions and/or interrupted substantially over the total length of the portion. This also applies for the extension of the support member transversely to the conveying direction or between lateral boundaries of the conveying width determined by the portion.

In the case of conveying runners support members could admittedly be formed by individual ledges, support rolls, etc., but it is appropriate for the support member to form a substantially through table surface, which then forms a passage prevention means in the form of a cover or shield between adjacent conveying runners, so that no objects, dirt, etc. can pass through gaps between adjacent runners. As the particular conveying runner can be supported by its back in large-surface manner on the support member substantially over its entire width and/or length, it need not be placed under a particularly high tensile stress and could instead sag after releasing the support member.

The support member could be brought into and out of the support position independently of the portion or a movement diverging from its conveying movement, but it is appropriately arranged in fixed manner with respect to the portion, so that in each position of the latter it assumes the described position with respect thereto. With part of its extension the support member can be substantially congruent to the residual portion, e.g. in that a support member of the residual portion and a support member of the portion reciprocally at least partly overlap in each position. Instead of being located on the front or top side, the support member of the portion is appropriately located on the back of the support member of the residual portion. As a result the support member of the residual portion can form in each position of the portion an extension of its support member. In addition, the support member of the residual portion, with respect to its boundaries, can be arranged or constructed as described relative to the support member of the portion.

If the support member of the residual portion is constructed as a plate with a thickness of a few millimeters located in substantially contact-free manner on its back up to the front end and between lateral supports, then the support member of the portion can slide with its support face along said back and/or be moved with a gap spacing and .the support faces of the two support members are only reciprocally displaced by a negligibly small amount of a few millimeters transversely to the conveying plane and in each position. In addition, the support face of one support member only extends over a small step corresponding to this amount into the support face of the other support member, said step or sloping ramp being roughly the same as the thickness of the particular conveying runner or less. The transition area between the overlapping ends of the two support members is consequently substantially closed in the extended position, the retracted position and each intermediate position transversely to the conveying plane.

If the discharge outlet is at a relatively large distance from the inlet of the processing means following the conveyor, namely with a spacing which is as large or larger than the extension of a stack or the like in the conveying direction, then in the case of a fault in the processing means between said inlet and the discharge outlet there can be at least one stack, which then despite the opening of the discharge outlet is no longer conveyed into the latter and is instead moved on into the no longer functional processing means. To prevent this and independently of the described construction the discharge outlet is positioned very close to the inlet of the processing means, namely at a distance therefrom which is smaller than the extension of ten, five, three or one stack in the conveying direction, so that between the discharge outlet and the inlet of the processing means there can at the most be a correspondingly large number of stacks. If the outlet and inlet transversely to the conveying direction substantially have a common boundary edge, then after opening the outlet of the processing means it is no longer possible to supply stacks and instead in the processing means may only be located the particular stack during whose processing the fault occurred.

BRIEF FIGURE DESCRIPTION

These and further features can be gathered from the claims, description and drawings and the individual features, both singly and in the form of subcombinations, can be realized in an embodiment of the invention and in other fields and can represent advantageous, independently protectable constructions for which protection is hereby claimed. An embodiment of the invention is described in greater detail hereinafter relative to the drawings, wherein show:

FIG. 1 A conveying means according to the invention with the following parts of a conveying path in plan view.

FIG. 2 The conveying means according to FIG. 1 on a larger scale and a partly modified construction.

FIG. 3 A cross-section through the means of FIG. 2.

FIG. 4 A cross-section according to FIG. 3, but in a different working state.

DETAILED DESCRIPTION OF A PREFERRED EXAMPLE EMBODIMENT

Figure 1:
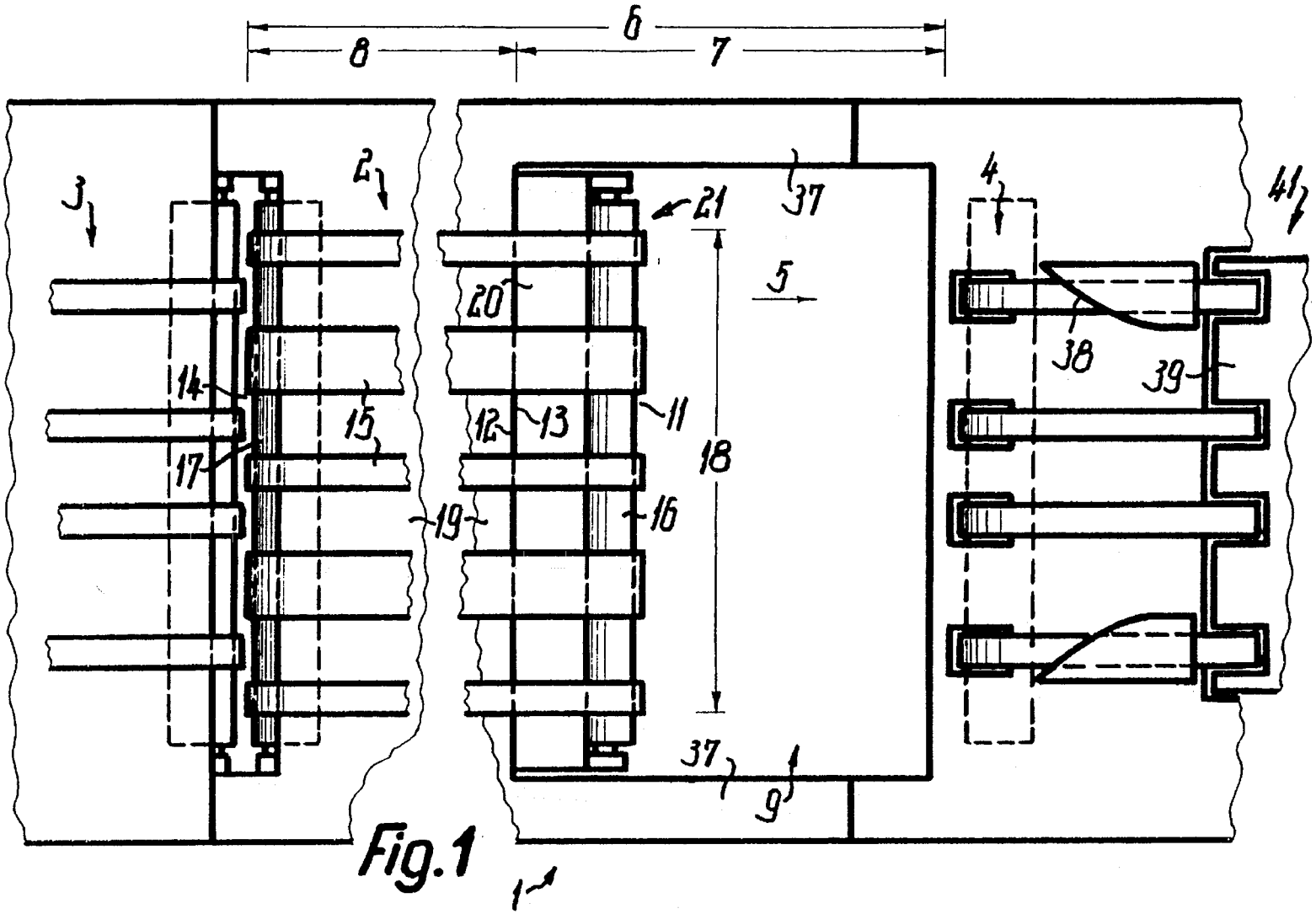
Figure 2:
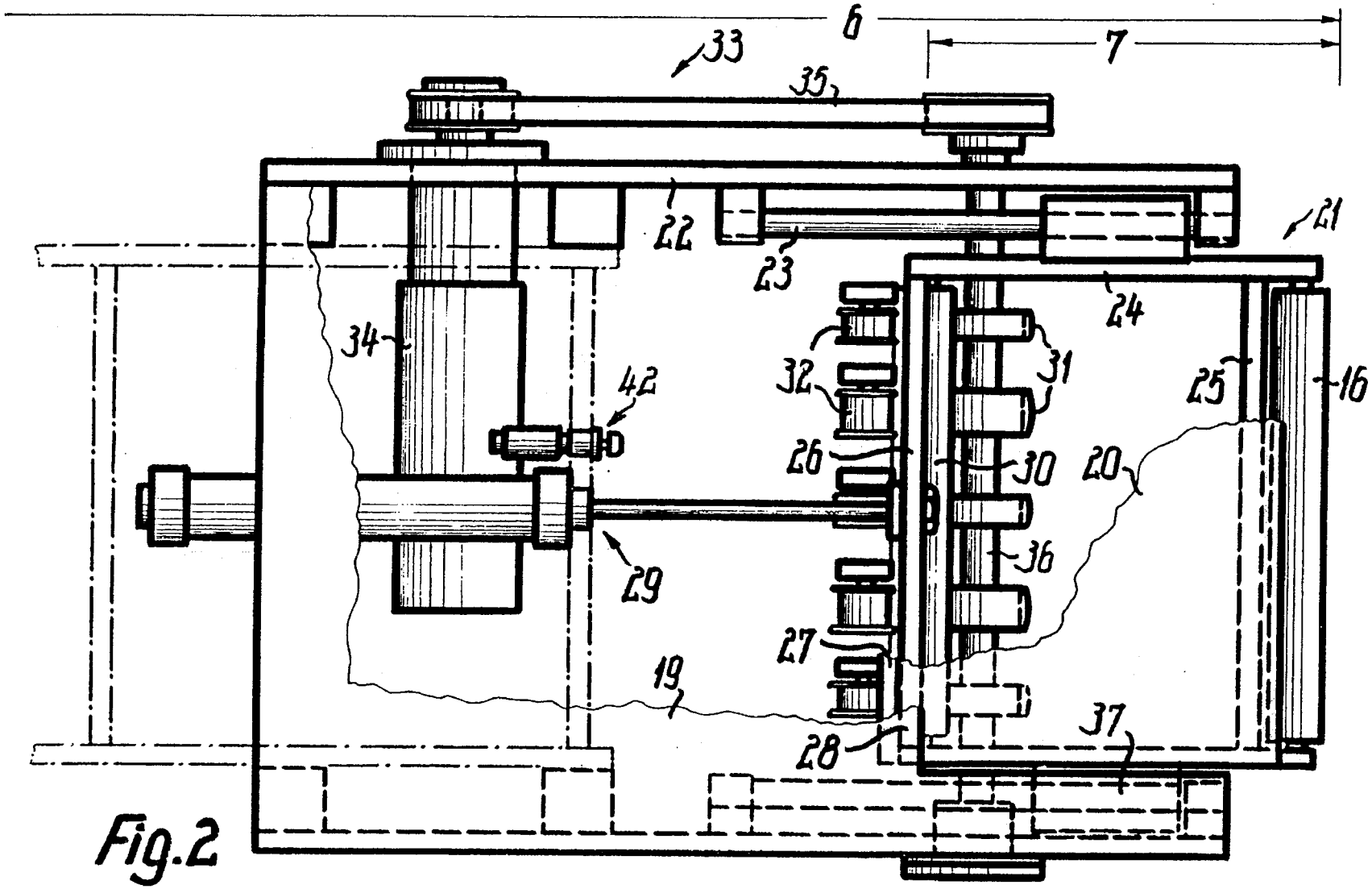
Figure 3:
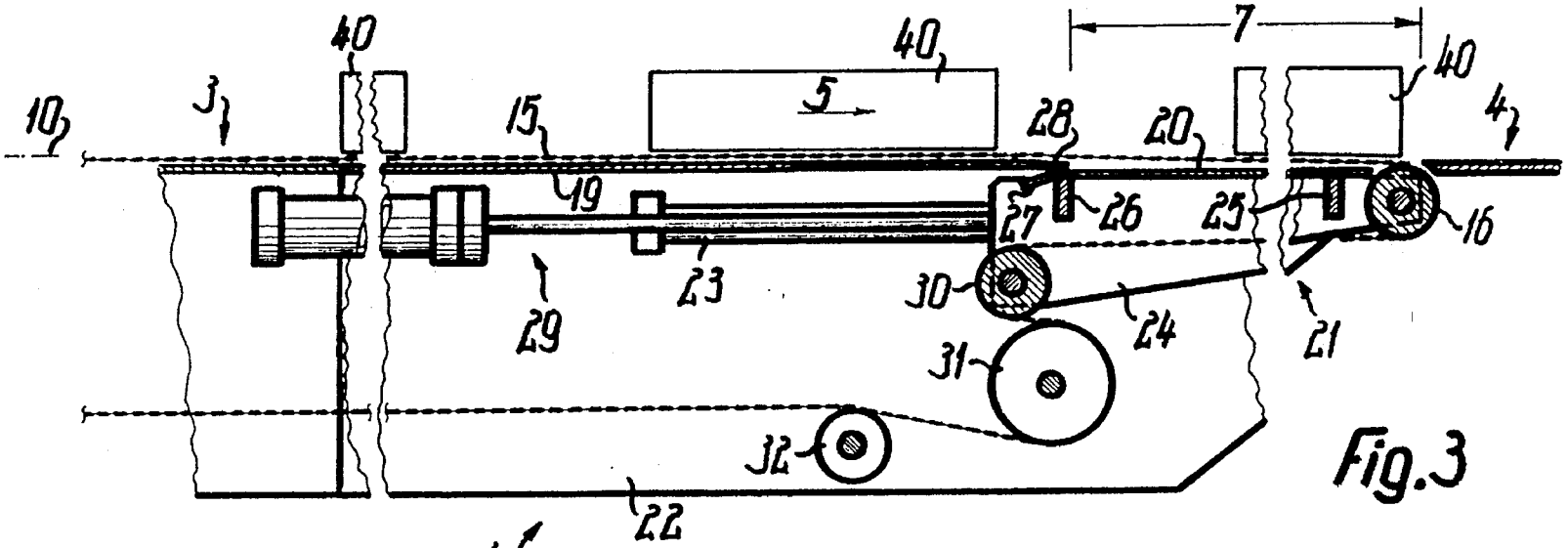
Figure 4:
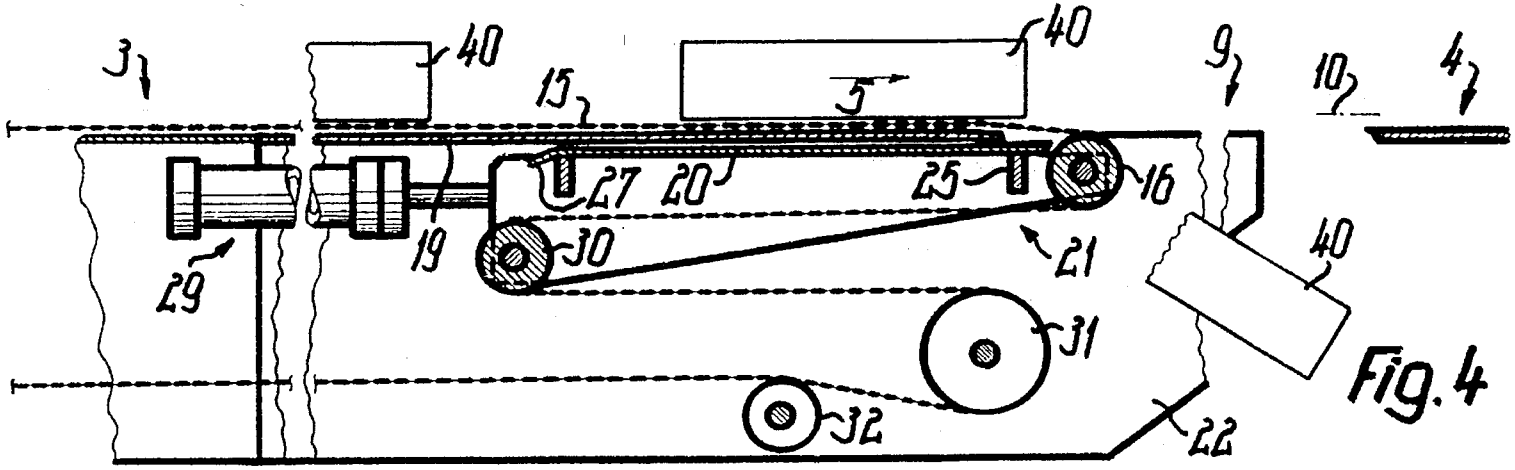

The conveying means 1, optionally with the exception of the conveying runners, can form a closed basic unit to be set up with a frame on a foundation or the like and which is to be so positioned between adjacent means that its conveyor 2 is supplied by a supplying conveyor 3 of an upstream means and which delivers the stacks to be conveyed to a moving away conveyor 4. All the conveyors 2 to 4 can be located approximately in a common conveying plane 10 or in a view of the latter and/or in side view has a continuous and roughly linear, common conveying direction 5. In cross-section transversely to the conveying direction 5, the conveying plane can be inclined to one side or be positioned approximately horizontally. Instead of being roughly vertical, the conveyors 2 to 4 are here positioned in such a way that the stacks engage thereon under their own weight.

The conveyor 2 has two connecting portions in the conveying direction 5, namely a front, shortenable portion 7 and a rear residual portion 8, which forms a fixed longitudinal part of the longest conveying section 6, which can be formed by the two conveying portions 7, 8. In the position according to FIG. 1 the portion 7 is shown in the retracted position, so that it forms a through or passage opening or an outlet 9 in the conveying plane through which the stacks until completely leaving the conveying plane are positioned transversely thereto on the back or underside of the conveying section and are collected there or can be conveyed away transversely to the conveying direction 5 and roughly parallel to the conveying plane 10.

This outlet 9 is bounded at its rear end by the front end 11 of the retracted portion 7 and can have a length which is roughly the same as the length of the stack or smaller than the latter. The length of the residual portion 8 is larger than the length of a stack, so that e.g. three or four spaced, succeeding stacks can be simultaneously located on the conveying portion 8. The length of the extended portion 7 is smaller than this or is only slightly larger than the length of a stack, so that generally there is only one stack on the portion 7. The conveying width 18 of the conveying portion 7, 8 is selected in such a way that in each case only one stack is conveyed in both directions.

It is admittedly conceivable to provide the extendable portion on a rear end of the residual portion and to transfer it counter to or transversely to the conveying direction into its extended position, but the arrangement is appropriately reversed. The rear, linear through end 12 of the portion 7 positioned transversely to the conveying direction 5 coincides with the front, correspondingly constructed end 13 of the portion 8, which is formed by a fixed edge positioned transversely to the conveying plane and with respect to which the portion 7 is moved. The rear end 14 of the residual portion 8 or the conveying section 6 is directly connected to the conveyor 3.

With the two conveying portions 7, 8 are associated common conveying runners 15 or conveyor belts with flat rectangular cross-sections to the conveying plane 10 and through from the front end 11 to the rear end 14 and optionally to the rear end of the conveyor 3. At the front end of the portion 7 the belts 15 are guided over approximately 180° by means of a reversing means 16, namely a cylindrical and freely rotatable reversing roller extending over all the belts 15. This reversing means 16 or the front tops of the belts 15 form the front end of the portion 7 and the rear boundary of the outlet 9, so that the delivery edge, via which the stack is transferred to the outlet 9 in the case of a retracted and then fixed portion 7, is formed by conveying or driven means or has such means. At the rear end 14 the conveying runners 15 are guided in the described manner by means of a further reversing means 17, which is constructed in the same way as reversing means 16. The conveying runners 15 are uniformly distributed over the conveying width 18, which is at the most as large or smaller than the width of the portion 7, with respect to which the residual portion 8 and the conveyors 4, 5 can be wider. Instead of in a plane transversely to the conveying plane 10, the conveying runners 15 are here roughly in the conveying plane 10.

The linear sides of the conveying runners 15 whose exposed or upper flat sides define the conveying plane and continue in the conveying direction 5 and which at the rear end of the stack could be pushing engaging driving means, are so supported with their flat sides remote from the conveying plane 10 in the vicinity of the residual portion 8 on a single common support member 19 in the form of a sheet metal plate or the like and in a substantially non-resilient, so that said support member 19 under the load of the stack located thereon elastically resiliently becomes deflected to an only insignificant extent, if at all, namely less than one to three times its thickness. The same applies regarding the support member 20, which supports the conveying runners 15 in the same way in the vicinity of the portion 7 and in each position of the latter forms a substantially uninterrupted extension of the front end 13 of the support member 19.

In the retracted position a front end part of the portion 7 is connected in the conveying direction 5 to the front end 13 as an effective conveying portion, which is much shorter than the residual portion 8 or a stack, so that only a narrow transverse strip of the support member 20 is exposed upstream of the front end 13. The front end of the support member 20 extends over part of the circumference of the reversing means 16, but not to its outermost or highest top and is only removed from said circumference by a gap spacing. Thus, with most of its diameter the reversing means 16 projects over the front, linear end of the support member 20. Instead of as side guides the support members 19, 20 or the outlet 9 are not located in a vertical plane, but horizontally in cross-section or as a whole. The support members 19, 20 and the conveying runners 15 form a two to three layer support. The portion 7 has a truck 21 located entirely below the conveying plane 10 and which is movable into and counter to the conveying direction 5 in such a way that with its rear end it always engages over or under the support member 19 at least in the vicinity of its front end 13, which also applies with respect to the rear end of the support member 20. For this purpose the support member 10 is fixed on the upper longitudinal edges of two side walls 22 of the frame and in the vicinity of the retracted truck 21 is so freely tensioned without further support between said side walls 22 that it can receive on its underside the truck 21 or the support member 20 fixed to its top side in a whole-surface contacting manner. The support or top side of the support member 20 is therefore always roughly in the plane of the underside of the support member 19 remote from the support side, which is e.g. at the most roughly 3 mm thick and is substantially through planar on each plate side.

To the insides of the side walls 22 and with a limited spacing from the conveying plane 10 is fixed a guide rail 23, e.g. a cylindrical rod or the like parallel to the conveying direction 5 and which is spaced from the associated lateral outside of the truck 21 and on which the latter is displaceably mounted with guide sleeves or the like, e.g. with roll body bushes. The truck 21 has in plan view a rectangular, frame-like body, whose side members 24 located in the vicinity of the lateral boundaries of the conveying width 18 carry on their outsides the slide sleeves, which are interconnected immediately behind the reversing means 16, as well as on its rear end by means of transverse members 25, 26. The reversing means 16 is so rotatably mounted on the front ends of said side members 24 that it projects over the front end of the body or the side members 24.

The upper narrow edges of the members 24, 26 are located in one plane and carry the support member 20, whose underside rests directly on said narrow sides. Thus, in the retracted position, the truck 21 or the support member 20 provides an additional support of the support member 19 against deflections or sagging.

The rear, narrow, strip-like edge 27 of the support member 20 projects rearwards slightly over the rear transverse member 26 and is angled downwards under an obtuse angle in the vicinity of the rear edge of the transverse member 26. The front, narrow, strip-like edge 28 of the support member 19 forming the front end 13 can be angled under a few radians against the support face of the support member 20 and/or can be thickness-reduced in acute-angled manner for forming a shallow sloping ramp towards the front end 13, so that it forms a smoothed sliding face, which can always slide uninterruptedly on the support face of the support member 20. In the extended position the rear transverse member 26 for supporting purposes is located directly below the edge 28 and in the retracted position the front transverse member 25 is in the immediate vicinity under the edge 28, which it also supports against deflections. The front end of the support member 20 in the extended or conveying direction 5 projects slightly over the transverse member 25 and also the reversing means 16 projects forwards over the body or its side members 24.

The portion 7 or the truck 21 is movable into and against the direction 5 by a drive 29, particularly a linear drive, the movement or the control of the drive 29 can be initiated manually. The drive 29 is here formed by a pneumatic or hydraulic cylinder-piston unit, which is located parallel to the direction 5 between the side walls 22, the guides 23 or the side members 24 roughly in the centre of the working width 18 with a limited spacing directly below the support member 19, the free, front end of the piston rod being fixed to the rear transverse member 26. The working cylinder is only fixed by its front end to a transverse member connecting the side walls 22 and also need not belong to said basic unit and can instead be installed jointly with the conveyor 3, which engages below the support member 19 with said transverse member and longitudinal members connected by it in such a way that the means 1 is carried without direct foundation support merely by suspension on one or two conveyors 3, 4 and either forms an unsupported, freely projecting cantilever bracket of the conveyor 3 or 4 and/or a bridge linking the conveyors 3, 4. The guide portions running on the guide rails 23 are roughly in the centre of the length of the truck 21 or are spaced from the front and rear end of its body, so that only a single guide piece is necessary on each side.

In order to maintain under roughly equal tension the continuously revolving conveying runners 15 in each position of the portion 7, tightening means are provided, which during the retraction of the truck 21 receive corresponding length parts of the conveying runners 15 and free them again on extension. The conveying runners 15 are guided by the reversing means 16 below the conveying plane 10 in the rearwards direction to the top of a further reversing means 30, which as a cylindrically and freely rotatable roller common to all the runners 15 and with roughly the same diameter as the reversing means 16 is mounted below the rear transverse member 26 between and on the side members 24. The conveying runners 15 are reversed about said reversing means 30 by means of roughly 180° forwards to separate, disk or roll-like reversing means 31, which on a common shaft are positioned in non-rotary manner and have convex or elastically resilient contact surfaces, so that the particular conveying runner 15 can be auto-oriented with respect to its reversing means 31 parallel to the reversing axis. By means of the reversing means 31 having a larger reversing radius than the reversing means 16, 30 the conveying runners 15 are in each case guided via a separate lateral guide 32, which is e.g. formed by a freely rotatable roll with lateral guide elements projecting over its contact surface. The reversing angle on the reversing means 30 is greater than 180° and that on the reversing means 32 smaller than this. The reversing spindles of both reversing means 31, 32 are fixed with respect to the frame or truck 22.

In the extended position of the portion 7 the reversing means 30, in a view of the conveying plane 10, is positioned behind the reversing means 31 and in front of the reversing means 32. If the truck 21 is retracted, then the reversing means 30 runs rearwards with respect to the reversing means 31, so that between both reversing means 30, 31 is additionally received the precise length of the particular runner 15 by which the conveying section 6 is shortened by retraction of the reversing means 16.

For driving the conveying runners 15 is provided a conveying drive 33, whose motor 34 is so fixed to a side wall 22, so that it is substantially freely projecting between the side walls 22 and under the working cylinder of the drive 29, namely with spacing behind the-portion 7, upstream of the reversing means 17 and roughly parallel to the reversing means 16, 17, 30, 31, 32. To the outside of the side wall 22 the driven shaft of the motor 34 is drive-connected by means of a gear 35, e.g. a single-stage or transmission-free belt drive, to a drive shaft 36, which is mounted below the truck on the side walls 22 and carries the reversing means 31 in non-rotary manner, so that they transfer the driving force to the conveying runners 15.

In a view transversely to the conveying plane 10 the lateral longitudinal boundaries of the portion 7, the support member 20 or the truck 21 run linearly parallel to the direction 5 at least in the areas located in the particular position upstream of the front end 13 and roughly in the plane of the support member 19. The support member 19 is wider than the support member 20 and projects on either side with narrow marginal zones over said longitudinal boundaries of the support member 20 and which are extended at the ends of the front terminal edge 13 in direction 5 to lateral legs 37 constructed in one piece with the remaining support member 19. These lateral legs 37 can be roughly in the plane of the support member 20 or 19, so that they are upwardly displaced e.g. by said limited thickness with respect to the support plane of the support member 20. Thus, optionally they can engage slightly over the lateral marginal areas of the support member 20, so that in a view of the conveying plane between their inner edges and the side edges of the support member 20 no gap is formed. The lateral legs 37 extend up to the front ends of the side walls 2 or the guide rails 23 and upwardly completely cover the same, as well as the associated guide pieces. The truck 21, conveying runners 15 and reversing means 16, in the extended position, project forwards over said front ends. Thus, to said front ends can be connected the conveyor 4 or its table-like support member with oppositely directed lateral legs, so that the last mentioned support member bounds a front, smaller part of the outlet 9.

The conveyor 4 e.g. belongs to a processing means 41, such as e.g. a packing means for the stacks 40, which has in the vicinity of the conveyor 4 a centering means 38, so as to precisely laterally orient the stacks during passage. Immediately following the centering means 38, in each case one stack 40 passes onto a lifting table 39 or the like, which serves to raise the stack 40 against an initially still spread out packing layer, e.g. paper and is thereby enveloped with said packing layer. Between the front end 11 of the extended portion 7 and the processing station 41 there is a single through or non-divided conveyor 4, whose length is approximately the same as that of a single stack 40. The conveyor belts 15 of the conveyor 2 have two different widths, a central conveyor belt or a lateral outermost conveyor belts having a smaller width than the intermediate conveyor belts. The number of conveyor belts of the conveyor 2 is smaller than double the conveyor belts of the conveyor 3 or 4, less one belt and can diverge by at the most one to two belts from the number of belts of the conveyor 3 or 4 or can be the same as said number of belts. Thus, at least two to all the belts of connecting conveyors 2, 3 or 2, 4 in the conveying direction 5 are substantially aligned or directly interconnected, so that the front end of each belt can be directly connected to the rear end of the following belt and between adjacent conveyors there is no need for intermediate conveyors 2, 4, which in each case only have a length of roughly a stack 40.

The conveyor 3 can be a transverse conveyor of a paper-processing machine, in which transversely to the conveying direction 5 in each case one paper web can be drawn from one or more paper rolls and then successively longitudinally cut continuously using corresponding means, can be transversely cut to individual sheet layers, the latter are reciprocally overlapped and flush superimposed to form stacks 40, said stacks 40 then being transferred transversely to the conveying direction 5 to the inlet of one or two juxtaposed conveyors 3 and then conveyed in one of the two associated conveying paths to separate means 41. In normal operation the portion 7 is extended in such a way that it is directly connected to the rear end of the conveyor 4 and the outlet 9 is substantially uninterruptedly or tightly closed, so that the stacks 40 can be transferred directly to the conveyor 4 from the conveyor 2.

If an operator detects a fault on a stack at the paper processing machine, then said stack 40 is so marked e.g. by manual operation f a contact with electronic means that its further conveying movement is monitored. As soon as the faulty stack 40 is the closest to the portion 7, the latter is retracted using electronic means and consequently the outlet 9 is opened. The start of this opening appropriately takes place when the stack 40 is at least partly or completely in the vicinity of the discharge table or the portion 7, the speed of the retraction movement being roughly the same as the conveying speed of the conveying runners 15 or is the same or greater than this. As a result the support member 20 or the conveying runners 15, in addition to the continuous further conveying on movement of the stack 40 are drawn away under the latter. Thus, the stack 40 is deflected downwards through the outlet 9 by means of the rounding formed by the reversing means 16 or the front end of the truck 21 and it drops onto a supporting surface located below the outlet 9 or the frame 22 from which the collected stacks 40 are removed transversely to the conveying direction 5 by means of the lateral boundary of the conveying path or can be conveyed out with a conveyor. Before the following, next stack 40 has reached the front end of the support member 20 or the reversing means 16, the portion 7, optionally at said speed, is again extended into its normal position, said extension movement only commencing when the front end of the stack 40 has already passed over the front end 13 and therefore reach the retracted support member 20.

The described opening of the outlet 9 can also take place if a fault occurs in the means 41. As the length ratios are selected in such a way that in the case of a fault in the means 41 or in the vicinity of the conveyor 4 there can only be the fault-participating stack 40, by opening the outlet 9 it is possible to avoid any further stack 40 passing into the vicinity of the conveyor 4 or the means 41. After removing the fault the outlet 9 is closed again. Thus, in the case of a fault the paper-processing machine or conveyors 2, 3 need not be stopped. The closing or opening process can be controlled with at least one limit switch 42 or the like, which is e.g. operated by stop action and shuts down the drive 29. The limit switch 42 is appropriately fixed roughly parallel and close to the drive cylinder to a cross-member of the frame and can be operated by the member 26 or the like to which is also coupled the piston rod of the drive.

We claim:

1. A conveying system (1) for sheet layers, the sheet layers being stackable into stacks (40), said conveying system comprising:

a conveyor (2) having a conveying dimension (6) in a conveying direction (5), said conveyor (2) defining a conveying plane (10), said conveyor (2) having a conveying width extension transverse to said conveying dimension, and said conveyor having separate first and second conveying portions (7, 8) along said conveying dimension including a residual conveying portion (8), at least one of said first and second conveying portions (7) being movable into different operating positions with respect to said residual portion (8) for modifying said conveying dimension (6), said at least one of said conveying portions (7) being movable as a motion portion between an extended position and a retracted position at least partly retracted within said conveying dimension (6); in the extended position, said motion portion (7) extending beyond said conveying dimension in the conveying direction (6), located substantially in said conveying plane (10) and having supporting ends including a front end (11) and a rear end (12), said motion portion (7) including conveyor runner means for engaging and conveying the sheet layers, said conveyor runner means including a plurality of individual exposed conveying runners (15) spaced, juxtaposed and distributed across said conveying width extension, thereby providing at least one runner gap between said individual conveying runners (15), supporting means for at least in said extended position substantially rigidly supporting the sheet layers in said conveying plane substantially entirely over said conveying width extension and at a distance from at least one of said supporting ends (11, 12) and, passage prevention means for preventing dirt and objects from passing through said at least one runner gap; in said extended position and said retracted position, said passage prevention means including a shield (20) operationally covering said at least one runner gap.

2. The according to claim 1, wherein, in at least one of said operating positions, said motion portion (7) overlaps said residual portion (8) in at least one direction substantially parallel to said conveying plane (10), said motion portion (7) being displaceable with respect to said residual portion (8) substantially parallel to said conveying plane (10), said supporting means including said passage prevention means and being provided for substantially rigidly supporting the sheet layers between said supporting ends (11, 12) and up to said front end (11) when said motion portion is in said extended position, said conveying runners (15) including front sides for contact with the sheet layers and back sides remote from said front sides for support by said supporting means (20), said shield extending along said back sides.

3. The system according to claim 1, wherein said supporting means include a support member (20) for said motion portion (7) and a dimensionally substantially rigid support member (19) for the residual portion (18); in a view transverse to said conveying plane (10) said support member (20) for said motion portion (7) being located in the vicinity of said dimensionally substantially rigid support member (19) of said residual portion (18); in at least one of said retracted position and said extended position, said support member (20) providing said shield.

4. The system according to claim 1, wherein at least one of said first and second conveying portions (7, 8) has a support member (20, 19) for rigidly supporting the sheet layers, said support member (20, 19) having a length extension extending in said conveying direction and a width extension transverse to the length extension at least as wide as said conveying width extension, said support member (19, 20) of at least one of said conveying portion (7, 8) supporting the sheet layers substantially uniformly over at least one of said length extension and said width extension and over a layer width parallel to said width extension, said supporting means including said shield (20).

5. The means according to claim 4, wherein said support member (20) of said motion portion (7) has a border edge (27); and in said extended position, said border edge of said support member (20) of said motion portion (7) engages below said support member (19) of said residual portion (8), said motion portion (7) being movably mounted with respect to said residual portion (8) substantially parallel to said conveying direction (5), said support member being said shield.

6. The means according to claim 4, wherein in said extended position and in a view transverse to said conveying plane (10) a rear end (27) of said support member (20) of said motion portion (7) provides a substantially uninterrupted continuation of said support member (19) of said residual portion (8), said support member (19, 20) providing said shield.

7. The means according to claim 4, wherein in said retracted position and in a view transverse to said conveying plane (10) said support member (20) and said shield of said motion portion (7) is largely substantially congruent to said support member (19) of said residual portion (8), guide means (31, 32) being provided for separately laterally positioning said juxtaposed conveying runners (15).

8. The means according to claim 4, wherein said support member (19) of one of said conveying portions (8) is wider than said support member (20) of the other of said conveying portions (7), guide and reversing means begin provided for laterally positioning and reversing said juxtaposed conveying runners (15) in the vicinity of a reversing axis, in said reversing axis said guide means including separate reversing members (31, 32) for said conveying runners (15).

9. The system according to claim 4, wherein substantially in a common plane with said support member (19, 20) said support member (19) of one of said conveying portions (8) laterally engages round on at least one side said support member (20) of the other of said conveying portions (7).

10. The system according to claim 4, wherein said support member (19) of one of said conveying portions (8), in a view transverse to said conveying plane (10), provides boundaries (37) of a U-shaped forwardly open receptacle for said support member (20) of the other of said conveying portions (7), said boundaries (37) being provided in a common plane with said at least one of said support members (19, 20).

11. The system according to claim 4, wherein in said extended position said support member (19) of said residual portion (8) engages over said support member (20) of said motion portion (7) with at least one leg (37) located laterally outside said conveying width extension (18) over only part of said length extension of said support member (20) of said motion portion (7), said at least one leg (37) being provided in a common plane with a remainder of said support member (19) of said residual portion.

12. The system according to claim 4, wherein said support member (19) of one of said conveying portions (8) laterally engages along said support member (20) of the other of said conveying portions (7) substantially parallel to said conveying direction (5) and substantially in a common plane with at least one of said support members (19, 20).

13. The system according to claim 4, wherein, in said extended position, said support member (20) of said motion portion (7) provides an outlet shield and cover for a discharge outlet (9) located in said conveying plane for discharging the sheet layers away from said conveying plane when freed from said motion portion (7) wherein said retracted position, said support member (19) of said residual portion (8) laterally bounding said discharge outlet (9) with at least one leg (37) located substantially in a support plane of at least one of said support members (19, 20).

14. The system according to claim 1, wherein the front end of the motion portion has a deflecting guide and further comprising at least one conveying runner (15) said conveying runner substantially continuously extending at least over both said conveying portions (7, 8) and over said deflection guide (16), in front of said front end a free motion space being provided, said front end being at least partly located downstream of said support member (20), providing said shield, in plan view on said conveying plane (10), said shield extending over said deflection guide (16).

15. A conveying system (1) for sheet layers, the sheet layers being stackable into stacks (40), said conveying system comprising:

a conveyor (2) having a conveying dimension (6) in a conveying direction (5), said conveyor (2) defining a conveying plane (10), said conveyor (2) having a conveying width extension transverse to said conveying dimension, and said conveyor having separate first and second conveying portions (7, 8) along said conveying dimension including a residual conveying portion (8), at least one of said first and second conveying portions (7) being movable into different operating positions with respect to said residual portion (8) for modifying said conveying dimension (6), said at least one of said conveying portions (7) being movable as a motion portion between an extended position and a retracted position at least partly retracted within said conveying dimension (6); in the extended position, motion portion (7) extending beyond said conveying dimension in the conveying direction (6), located substantially in said conveying plane (10) and having supporting ends including a front end (11) and a rear end (12), supporting means for at least in said extended position substantially rigidly supporting the sheet layers in said conveying plane substantially entirely over said conveying width extension and at a distance from at least one of said supporting ends (11, 12), wherein at least one of said first and second conveying portions (7, 8) has a support member (20, 19) for rigidly supporting the sheet layers, said support member (20, 19) having a length extension extending in said conveying direction and a width extension transverse to the length extension at least as wide as said conveying width extension, said support member (19, 20) of at least one of said conveying portion (7, 8) supporting the sheet layers substantially uniformly over at least one of said length extension and said width extension and over a layer width parallel to said width extension, further comprising centering means including a centering inlet (38); in conveying operation, said support member (19, 20) positionally substantially stable, said said sheet layers being conveyed relative to said support member (19, 20).

16. A conveying system (1) for sheet layers, the sheet layers being stackable into stacks (40), said conveying system comprising:

a conveyor (2) having a conveying dimension (6) in a conveying direction (5), said conveyor (2) defining a conveying plane (10), said conveyor (2) having a conveying width extension transverse to said conveying dimension, and said conveyor having separate first and second conveying portions (7, 8) along said conveying dimension including a residual conveying portion (8) at least one of said first and second conveying portions (7) being movable into different operating positions with respect to said residual portion (8) for modifying said conveying dimension (6), said at least one of said conveying portions (7) being movable as a motion portion between an extended position and a retracted position at least partly retracted within said conveying dimension (6); in the extended position, said motion portion (7) extending beyond said conveying dimension in the conveying direction (6), located substantially in said conveying plane (10) and having supporting ends including a front end (11) and a rear end (12), supporting means for at least in said extended position substantially rigidly supporting the sheet layers in said conveying plane substantially entirely over said conveying width extension and at a distance from at least one of said supporting ends (11, 12), wherein at least one of said first and second conveying portions (7, 8) has a support member (20, 19) for rigidly supporting the sheet layers, said support member (20, 19) having a length extension extending in said conveying direction and a width extension transverse to the length extension at least as wide as said conveying width extension, said support member (19, 20) of at least one of said conveying portion (7, 8) supporting the sheet layers substantially uniformly over at least one of said length extension and said width extension and over a layer width parallel to said width extension, wherein said support member (19, 20) provides a substantially continuously planar support table and sliding surface supporting the sheet layers in said conveying motion as the sheet layers are conveyed.

17. A conveying system (1) for sheet layers, the sheet layers being stackable into stacks (40), said conveying system comprising:

a conveyor (2) having a conveying dimension (6) in a conveying direction (5), said conveyor (2) defining a conveying plane (10), said conveyor (2) having a conveying width extension transverse to said conveying dimension, and said conveyor having separate first and second conveying portions (7, 8) along said conveying dimension including a residual conveying portion (8) at least one of said first and second conveying portions (7) being movable into different operating positions with respect to said residual portion (8) for modifying said conveying dimension (6), said at least one of said conveying portions (7) being movable as a motion portion between an extended position and a retracted position at least partly retracted within said conveying dimension (6); in the extended position, said motion portion (7) extending beyond said conveying dimension in the conveying direction (6), located substantially in said conveying plane (10) and having supporting ends including a front end (11) and a rear end (12), supporting means for at least in said extended position substantially rigidly supporting the sheet layers in said conveying plane substantially entirely over said conveying width extension and at a distance from at least one of said supporting ends (11, 12) wherein at least one of said first and second conveying portions (7, 8) has a support member (20, 19) for rigidly supporting the sheet layers, said support member (20, 19) having a length extension extending in said conveying direction and a width extension transverse to the length extension at least as wide as said conveying width extension, said support member (19, 20) of at least one of said conveying portion (7, 8) supporting the sheet layers substantially uniformly over at least one of said length extension and said width extension and over a layer width parallel to said width extension, wherein said support members (19, 20) of at least one of said conveying portions (8, 7) is formed by a thin sheet plate; in said extended position, said support members (19, 20) of both said motion portion (7) and said residual portion (8) being located substantially in a common plane and being displaced relative to each other transversely to said conveying plane (10) at the most by substantially a thickness extension of said sheet plate, in cross-section at least one margin strip zone (28, 27) of at least one of said support members (19, 20) being substantially inclined with respect to said conveying plane (10) towards a backside of said support member (19, 20).

18. A conveying system (1) for sheet layers, the sheet layers being stackable into stacks (40), said conveying system comprising:

a conveyor (2) having a conveying dimension (6) in a conveying direction (5), said conveyor (2) defining a conveying plane (10), said conveyor (2) having a conveying width extension transverse to said conveying dimension, and said conveyor having separate first and second conveying portions (7, 8) along said conveying dimension including a residual conveying portion (8), at least one of said first and second conveying portions (7) being movable into different operating positions with respect to said residual portion (8) for modifying said conveying dimension (6), said at least one of said conveying portions (7) being movable as a motion portion between an extended position and a retracted position at least partly retracted within said conveying dimension (6); in the extended position, said motion portion (7) extending beyond said conveying dimension in the conveying direction (6), located substantially in said conveying plane (10) and having supporting ends including a front end (11) and a rear end (12), supporting means for at least in said extended position substantially rigidly supporting the sheet layers in said conveying plane substantially entirely over said conveying width extension and at a distance from at least one of said supporting ends (11, 12), wherein at least one of said first and second conveying portions (7, 8) has a support member (20, 19) for rigidly supporting the sheet layers, said support member (20, 19) having a length extension extending in said conveying direction and a width extension transverse to the length extension at least as wide as said conveying width extension, said support member (19, 20) of at least one of said conveying portion (7, 8) supporting the sheet layers substantially uniformly over at least one of said length extension and said width extension and over a layer width parallel to said width extension, wherein at least one of said support members (19, 20) is provided as a support for at least one conveying runner (15) having remote and substantially parallel sides for support on said support member (19, 20) and for supportingly receiving the sheet layers.

19. The system according to claim 18, wherein transversely to said conveying direction (5) are spacedly juxtaposed a plurality of said conveying runners (15), at least one connecting conveyor (3, 4) longitudinally connected to said conveyor (2) being provided and having a number of juxtaposed conveying runners, said number being greater than half a total number of said conveying runners (15) of said conveyor (2), plus one additional conveying runner.

20. The system according to claim 19, wherein said conveying runners provide adjacent runners and intermediate spacings, at last one of said spacings being at least as large as a width extension of at least one of said adjacent runners.

21. A conveying system (1) for sheet layers, the sheet layers being stackable into stacks (40), said conveying system comprising:

a conveyor (2) having a conveying dimension (6) in a conveying direction (5), said conveyor (2) defining a conveying plane (10), said conveyor (2) having a conveying width extension transverse to said conveying dimension, and said conveyor having separate first and second conveying portions (7, 8) along said conveying dimension including a residual conveying portion (8), at least one of said first and second conveying portions (7) being movable into different operating positions with respect to said residual portion (8) for modifying said conveying dimension (6) said at least one of said conveying portions (7) being movable as a motion portion between an extended position and a retracted position at least partly retracted within said conveying dimension (6); in the extended position, said motion portion (7) extending beyond said conveying dimension in the conveying direction (6), located substantially in said conveying plane (10) and having supporting ends including a front end (11) and a rear end (12), supporting means for at least in said extended position substantially rigidly supporting the sheet layers in said conveying plane substantially entirely over said conveying width extension and at a distance from at least one of said supporting ends (11, 12), wherein at least one of said first and second conveying portions (7, 8) has a support member (20, 19) for rigidly supporting the sheet layers, said support member (20, 19) having a length extension extending in said conveying direction and a width extension transverse to the length extension at least as wide as said conveying width extension, said support member (19, 20) of at least one of said conveying portion (7, 8) supporting the sheet layers substantially uniformly over at least one of said length extension and said width extension and over a layer width parallel to said width extension, wherein at least one of said support members (20) is located on a wagon (21) providing an inherently stiff and self-supporting bridge only laterally mounted on guide rods (23), on a backside of said wagon (21) a deflection guide (30) for a conveying runner being provided and being commonly displaceable with said wagon (21) from said deflection guide (30) said conveying runner (15) being guided over a driven deflection guide (31) mounted on a base (22) operationally displaceably carrying said truck (21).

22. A conveying system (1) for sheet layers, the sheet layers being stackable into stacks (40), said conveying system comprising:

a conveyor (2) having a conveying section (6);

said conveyor having a discharge outlet (9) for discharging the sheet layers out of said conveying section (6), and said conveyor having a downstream connecting end for connecting said conveyor (2) to a centering inlet (38) of a processing means (41) for laterally centering the sheet layers, wherein said discharge outlet (9) is located substantially directly adjacent to at least one of said connection end and said centering inlet.

23. The system according to claim 22, wherein said processing means include packing means (41) for packing the sheet layers, said conveyor (2) having a motion portion (7) for opening and closing said discharge outlet (9), when said discharge outlet (9) is substantially closed, a front end (11) of said motion portion (7) directly connecting to a single connecting conveyor (4), said connecting conveyor (4) directly connecting said front end (11) with said packing means (41).

24. The system according to claim 23, wherein said connecting conveyor (14) uninterruptedly and continuously passes through to a packing station (39) of the packing means (41), said packing station including wrapping means for displacing the sheet layers relative to a wrapper.

25. The system according to claim 22, wherein a downstream boundary of said discharge outlet (9) is provided by a conveyor support member of the processing means (41), said processing means (41) including said centering means (38) for laterally centering the sheet layers while passing onto a processing support (39) of said processing means (41).

26. A conveying system for conveying layer stacks (40) formed of stacked paper sheet layers along a conveying plane in a conveying direction (5), said conveying system comprising:

an extendable conveyor having an upstream end (14) and a downstream end (11); in an extended position, said conveyor (2) having a maximum conveying extension (6) subdivided into a fixed conveyor section (8) and an extendable conveyor section (7), said fixed conveyor section (8) providing said upstream end (14), said extendable conveyor section (7) including a carriage (21) mounted with respect to said fixed conveyor section (8) to be displaceable relative to said fixed conveyor section (8) in directions parallel to said conveying direction (5), said extendable conveyor section (7) providing said downstream end (11);

said extendable conveyor (2) including a plurality of conveyor belts (15) including upper belt sections, said upper belt sections having upper belt sides lying within said conveying plane and provided for engaging and conveying the layer stacks (40), said upper belt sections (15) having remote belt sides remote from said upper belt sides and provided for supporting said upper belt sections (15), said upper belt sections (15) being laterally juxtaposed with intermediate spacings providing at least one belt gap between said upper belt sections (15);

at said downstream end (11), said upper belt sections (15) running over a frontal deflection guide (16); upstream of said frontal deflection guide (16), said upper belt sections (15) running over a rear deflection guide (17); wherein said extendable conveyor section (7) opens and closes an outlet (9) including a passage opening for passing the stacks (40) away from said conveying plane (10) in a direction transverse to said conveying plane (10); when open, said outlet opening (9) begin bounded at a rear opening end by said downstream end (11); when closed, said downstream end (11) connecting to an outfeed conveyor (4) receiving said stacks (40) from said downstream end (11); said outlet opening (9) defining a front section located downstream of said downstream end (11), said front section being bounded by said outfeed conveyor (4) when said outlet (9) is open;

between said frontal and rear deflection guides (16, 17), said upper belt sections (15) being substantially rigidly supported against motions transverse to said conveying plane (10) said at least one support member (19, 20) engaging said remote belt sides;

drive means including a motor drive (29) for positively displacing said carriage (21) to extend and retract said extendable conveyor section (7); and control means (42) for controlling opening and closing of said outlet opening (9) by stopping the driving of said carriage (21) by with said motor drive (29).

27. The conveying system according to claim 26, wherein said upper belt sections (15) extend over both said fixed conveyor section (8) and said extendable conveyor section (7), said rear deflection guide (17) being disposed at said upstream end (14), said upper belt sections (15) being supported against said motions transverse to said conveying plane (10) along at least one of said fixed conveyor section (8) and said extendable conveyor section (7) by said at least one support member (19, 20);

further comprising an infeed conveyor (3) for feeding the stacks (40) to said extendable conveyor (2), said upstream end (14) connecting to said infeed conveyor, said at least one support member (19, 20) extending over and closing said at least one belt gap, said control means including a switch (42) actuated by said carriage (21).

28. The conveying system according to claim 26, wherein said at least one support member (19, 20) includes separate first and second support members (19, 20) displaceable relative to each other; said first support member (19) including a front support end (13) at a downstream portion; said first support member (19) supporting said upper belt sections (15) along said fixed conveyor section (8) and said second support member (20) supporting said upper belt sections (15) along said extendable conveyor section (7) substantially up to said frontal deflection guide (16), said frontal deflection guide (16) being mounted on said carriage (21) at said downstream end (11), said first and second support member (19, 20) being superimposed when said outlet opening (9) is open.

29. The conveying system according to claim 26, wherein said at least one support member (19) supports said upper belt section (15) along said fixed conveyor section (8); said at least one support member (19) connecting to at least one member leg (37) at a downstream end edge (13); said at least one member leg (37) laterally extending in said conveying direction (5) to project past said downstream end edge (13), said at least one member leg (37) being oriented substantially co-planar with said at least one support member (19, 20) and connecting to said outfeed conveyor (4).

30. The conveying system according to claim 26, wherein said at least one belt gap includes a plurality of belt gaps commonly closed by at least one of said support members (19, 20), guide means (32) being provided for separately laterally guiding said conveyor belts (15), said guide means including lateral guide elements.

31. The conveying system according to claim 26, wherein an infeed conveyor (3) is connected to said upstream end (14) for feeding the stacks (40) to said extendable conveyor (2), said extendable conveyor (2) providing a mounting component (1), said mounting component (1) providing a bridge linking between said infeed conveyor (3) and said outfeed conveyor (4), said mounting component (1) being supported by at least one of said infeed conveyor (3) and said outfeed conveyor (4).

32. The conveying system according to claim 26, further comprising a lifting table and wherein said outfeed conveyor (4) directly connects said downstream end (11) with said lifting table, said lifting table (39) receiving and raising the stacks (40), centering means (39) being provided in the vicinity of said outfeed conveyor (4) for laterally centering said stacks (40).

* * * * *